US008820463B2

(12) United States Patent
Phillips

(10) Patent No.: US 8,820,463 B2
(45) Date of Patent: Sep. 2, 2014

(54) SAFETY CONTROL SYSTEMS AND METHODS FOR HEAVY EQUIPMENT

(71) Applicant: Shane Phillips, Knoxville, TN (US)

(72) Inventor: Shane Phillips, Knoxville, TN (US)

( * ) Notice: Subject to any disclaimer, the term of this patent is extended or adjusted under 35 U.S.C. 154(b) by 0 days.

(21) Appl. No.: 13/629,038

(22) Filed: Sep. 27, 2012

(65) Prior Publication Data

US 2013/0264138 A1 Oct. 10, 2013

Related U.S. Application Data

(60) Provisional application No. 61/539,505, filed on Sep. 27, 2011.

(51) Int. Cl.
*B60K 28/02* (2006.01)
*B60K 26/00* (2006.01)
*G05G 7/00* (2006.01)

(52) U.S. Cl.
USPC ..... 180/272; 74/471 R; 180/315

(58) Field of Classification Search
USPC ..... 74/471 R, 471 XY, 479.01, 490.11, 74/490.12, 490.14, 490.15, 519, 523; 180/272, 315, 333
See application file for complete search history.

(56) References Cited

U.S. PATENT DOCUMENTS 1,122,368 A 12/1914 Curtis
1,861,511 A * 6/1932 Russell ..... 74/471 R
3,056,867 A * 10/1962 Eitel ..... 200/81 R
3,707,093 A * 12/1972 Worden ..... 74/471 XY
3,811,020 A * 5/1974 Johnson et al. ..... 200/61.88
3,818,154 A 6/1974 Presentey
4,006,386 A 2/1977 Duggan
4,181,828 A * 1/1980 Perry et al. ..... 200/18
4,237,629 A * 12/1980 Schmidt ..... 37/234
4,489,805 A * 12/1984 Okabe ..... 180/271
4,492,372 A 1/1985 Lorence et al.
5,002,454 A * 3/1991 Hadank et al. ..... 414/695.5
5,062,509 A * 11/1991 Carpenter et al. ..... 477/96
5,293,900 A * 3/1994 Karbassi et al. ..... 137/554
5,529,134 A * 6/1996 Yomogita ..... 180/6.2
5,550,539 A * 8/1996 Miki et al. ..... 341/20
5,664,637 A * 9/1997 Ohta et al. ..... 180/286
5,794,834 A 8/1998 Hamblin et al.
5,860,488 A 1/1999 Kim
H001831 H * 2/2000 Kelley et al. ..... 180/333
6,352,133 B1 * 3/2002 Ojima ..... 180/326
6,499,205 B1 * 12/2002 Laffan ..... 29/401.1
6,590,171 B1 * 7/2003 Wolf et al. ..... 200/51 LM
6,694,240 B1 * 2/2004 Swick et al. ..... 701/50
6,948,398 B2 * 9/2005 Dybro ..... 74/471 XY
7,165,472 B2 1/2007 Jo et al.
7,395,894 B2 7/2008 Jang et al.
7,681,686 B1 * 3/2010 Klas et al. ..... 180/331
7,913,798 B2 * 3/2011 Frett et al. ..... 180/333

(Continued)

*Primary Examiner* — Paul N Dickson
*Assistant Examiner* — Laura Freedman
(74) *Attorney, Agent, or Firm* — Pitts & Lake, P.C.

(57) ABSTRACT

A power control system, and a method of controlling supplied power, to be used with heavy equipment, the power control system including a power source to provide a power signal to be used in a mechanical operation of the heavy equipment, a mechanical device to perform the mechanical operation in response to receiving the power signal, first and second manual controls to maneuver the mechanical device, and first and second safety switches respectively integrated with the first and second manual controls such that the power signal is only received by the mechanical device while both the first and second safety switches are actuated by the user.

20 Claims, 4 Drawing Sheets

(56) References Cited

U.S. PATENT DOCUMENTS 7,934,329 B2 * 5/2011 Mintah et al. ..... 37/348
8,039,769 B2 * 10/2011 Asp et al. ..... 200/61.62
2002/0166267 A1 * 11/2002 McGugan ..... 37/348
2006/0232116 A1 10/2006 Jang et al.
2009/0118911 A1 * 5/2009 Scheer ..... 701/50
2009/0139360 A1 * 6/2009 Diccion ..... 74/471 XY

* cited by examiner

SAFETY CONTROL SYSTEMS AND METHODS FOR HEAVY EQUIPMENT

CROSS-REFERENCE TO RELATED APPLICATIONS

This application claims priority from U.S. Provisional Application No. 61/539,505 filed Sep. 27, 2011.

BACKGROUND

1. Field of Inventive Concept

The present general inventive concept relates to a control apparatus, and more particularly, to a safety device for a joystick type control apparatus.

2. Description of the Related Art

Monocontrol apparatus, of the type commonly referred to as "control columns" and/or "joysticks" (hereinafter "joysticks"), wherein movement of a single lever or an analogous control member can initiate and/or terminate a plurality of operations, are known in the art. Typically, a joystick includes a lever which is hinged or otherwise rotatably mounted at a base end thereof to an input device. Movement of the lever about the base end causes the input device to transmit a signal, for example, by completing and/or opening discrete electric circuits or by effecting translator, angular or other movements of links, gears, or analogous motion transmitting parts, in order to allow the input device to communicate a command from an operator of the joystick in response to movement of the lever in relation to the input device.

Joysticks have long been used as the principal control device for many types of vehicles, such as for example civilian and military aircraft. Furthermore, the employment of joysticks has become commonplace in many industrial and manufacturing applications, such as in cranes, assembly lines, forestry equipment, mining trucks, excavators, and other such heavy equipment. In such applications, unintentional movement of the joystick, such as can occur through unintentional collision with the joystick by a user, for example, during entry or exit of a cockpit of a piece of heavy equipment, can often result in unintentional miss-operation of the heavy equipment, which can in extreme instances lead to unexpected accidents and/or injury. Accordingly, a safety device which limits the ability of a joystick device to respond to unintentional movement of the joystick is desired.

BRIEF SUMMARY

The present general inventive concept, in various example embodiments, includes controlling power supplied to a mechanical device of a heavy equipment machine according to whether safety switches respectively integrated with manual controls are actuated by a user. Without actuation of the safety switches, power is not supplied to operate the mechanical device.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a power control system to be used with heavy equipment, the power control system including a power source to provide a power signal to be used in a mechanical operation of the heavy equipment, a mechanical device to perform the mechanical operation in response to receiving the power signal, first and second manual controls to maneuver the mechanical device, and first and second safety switches respectively integrated with the first and second manual controls such that the power signal is only received by the mechanical device while both the first and second safety switches are actuated by the user.

The first and second safety switches may be normally open, and actuation of the respective switches may close corresponding portions of a circuit between the power source and the mechanical device.

The first and second safety switches may be respectively actuated by engagement of a user's hands engaging the respective first and second manual controls.

The first and second manual controls may be joysticks.

The first and second safety switches may be triggers respectively integrated with the joysticks.

The first and second safety switches may respectively include one or more pressure sensors to detect the engagement of the user's hands.

The first and second safety switches may respectively include one or more capacitive sensors to detect the hand of the user.

The power control system may further include a transducer to provide power to the mechanical device in response to the first and second safety switches being actuated.

The mechanical device may include at least two hydraulic apparatuses respectively controlled by the first and second manual controls.

The foregoing and/or other aspects and advantages of the present general inventive concept may also be achieved by a heavy equipment machine including a power control system to control a mechanical operation of the heavy equipment machine, the power control system including a power source to provide a power signal to be used in a mechanical operation of the heavy equipment, a mechanical device to perform the mechanical operation in response to receiving the power signal, first and second manual controls to maneuver the mechanical device, and first and second safety switches respectively integrated with the first and second manual controls such that the power signal is only received by the mechanical device while both the first and second safety switches are actuated by the user.

The heavy equipment machine may be an earth-moving machine.

The mechanical device may be driven by at least two hydraulic apparatuses which operate on different axes of movement.

The mechanical device may be a loader, backhoe, excavator, or grader.

The first and second safety switches may be normally open, and actuation of the respective switches may close corresponding portions of a circuit between the power source and the mechanical device.

The first and second manual controls may be joysticks.

The first and second safety switches may be triggers respectively integrated with the joysticks.

The foregoing and/or other aspects and advantages of the present general inventive concept may also be achieved by a method of controlling power supplied to a mechanical device provided in a heavy equipment machine, the method including engaging first and second manual controls to maneuver the mechanical device, activating first and second safety switches respectively integrated with the first and second manual controls to cause power to be provided to the mechanical device, and deactivating either of the first and second safety switches to prevent power from being provided to the mechanical device.

The first and second manual controls may be joysticks and the first and second safety switches may be activated by applying pressure to first and second triggers respectively provided to the joysticks.

The first and second safety switches may be normally open, and activation of the respective switches may close corresponding portions of a circuit between a power source and the mechanical device.

Each of the first and second manual controls may respectively control at least one of a plurality of hydraulic apparatuses provided to the mechanical device.

The foregoing and/or other aspects and advantages of the present general inventive concept may also be achieved by a safety trigger for a joystick, wherein the joystick is configured for maneuvering heavy equipment with at least one electrical circuit to control at least a portion of the heavy equipment. The joystick may include a safety trigger for actuating the electrical circuit such that when the safety trigger is engaged, the electrical circuit is actuated and the portion of the heavy equipment is operational. In such an embodiment, disengagement of the safety trigger may render the portion of the heavy equipment nonoperational.

In various example embodiments of the present general inventive concept, the safety trigger may be in electrical communication with a power source and a transducer, the transducer supplying power to the portion of the heavy equipment. In such example embodiments, engagement of the safety trigger may place the power source in electrical communication with the transducer.

The foregoing and/or other aspects and advantages of the present general inventive concept may also be achieved by a heavy equipment machine having at least one hydraulic apparatus configured to receive operational power through a transducer. In various example embodiments, the heavy equipment machine may include a joystick configured to provide a signal to the heavy equipment machine to effect operation of the hydraulic apparatus, the joystick having a safety trigger disposed thereon, the safety trigger defining a disengaged position and an engaged position. In such example embodiments, a power source may be configured to selectively provide operational power to the hydraulic apparatus through the transducer when the safety trigger is in the engaged position. In this configuration, the power source is prevented from providing operational power to the hydraulic apparatus when the safety trigger is in the disengaged position. In various example embodiments of the present general inventive concept, the joystick may be disposed proximate an operator's seat of the heavy equipment machine.

The foregoing and/or other aspects and advantages of the present general inventive concept may also be achieved by a heavy equipment machine having a plurality of hydraulic apparatus configured to receive operational power through at least one transducer. In various example embodiments, the heavy equipment machine may include a first joystick configured to provide a first signal to the heavy equipment machine to effect operation of at least one of the hydraulic apparatus. The first joystick may have a first safety trigger disposed thereon, the first safety trigger defining a disengaged position and an engaged position. A second joystick may also be configured to provide a second signal to the heavy equipment machine to effect operation of at least one other of the hydraulic apparatus. The second joystick may have a second safety trigger disposed thereon, the second safety trigger also defining a disengaged position and an engaged position. In such example embodiments, a power source may be configured to selectively provide operational power to the plurality of hydraulic apparatus through the at least one transducer when both the first and second safety triggers are in the engaged positions. In this configuration, the power source may be prevented from providing operational power to the plurality of hydraulic apparatus when either the first or said second safety trigger is in the disengaged position.

In various example embodiments of the present general inventive concept, the power source may be in electrical communication with the first safety trigger. The first and second safety triggers may be in electrical communication with one another, such that when the first safety trigger is in the engaged position, the power source is placed in electrical communication with the second safety trigger, and when the first safety trigger is in the disengaged position, the power source is not in electrical communication with the second safety trigger. In various example embodiments, the second safety trigger may be in electrical communication with the at least one transducer, such that when the second safety trigger is in the engaged position, the first safety trigger is placed in electrical communication with the at least one transducer, and when the second safety trigger is in the disengaged position, the first safety trigger is not in electrical communication with the at least one transducer.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Reference will now be made to various example embodiments of the present general inventive concept, examples of which are illustrated in the accompanying drawings and illustrations. The example embodiments described herein are presented in order to explain the present general inventive concept by referring to the figures.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The described progression of processing operations described are merely examples, however, and the sequence of operations is not limited to that set forth herein and may be changed as is known in the art, with the exception of operations necessarily occurring in a certain order. Also, description of well-known functions and constructions may be omitted for increased clarity and conciseness.

Figure 1:
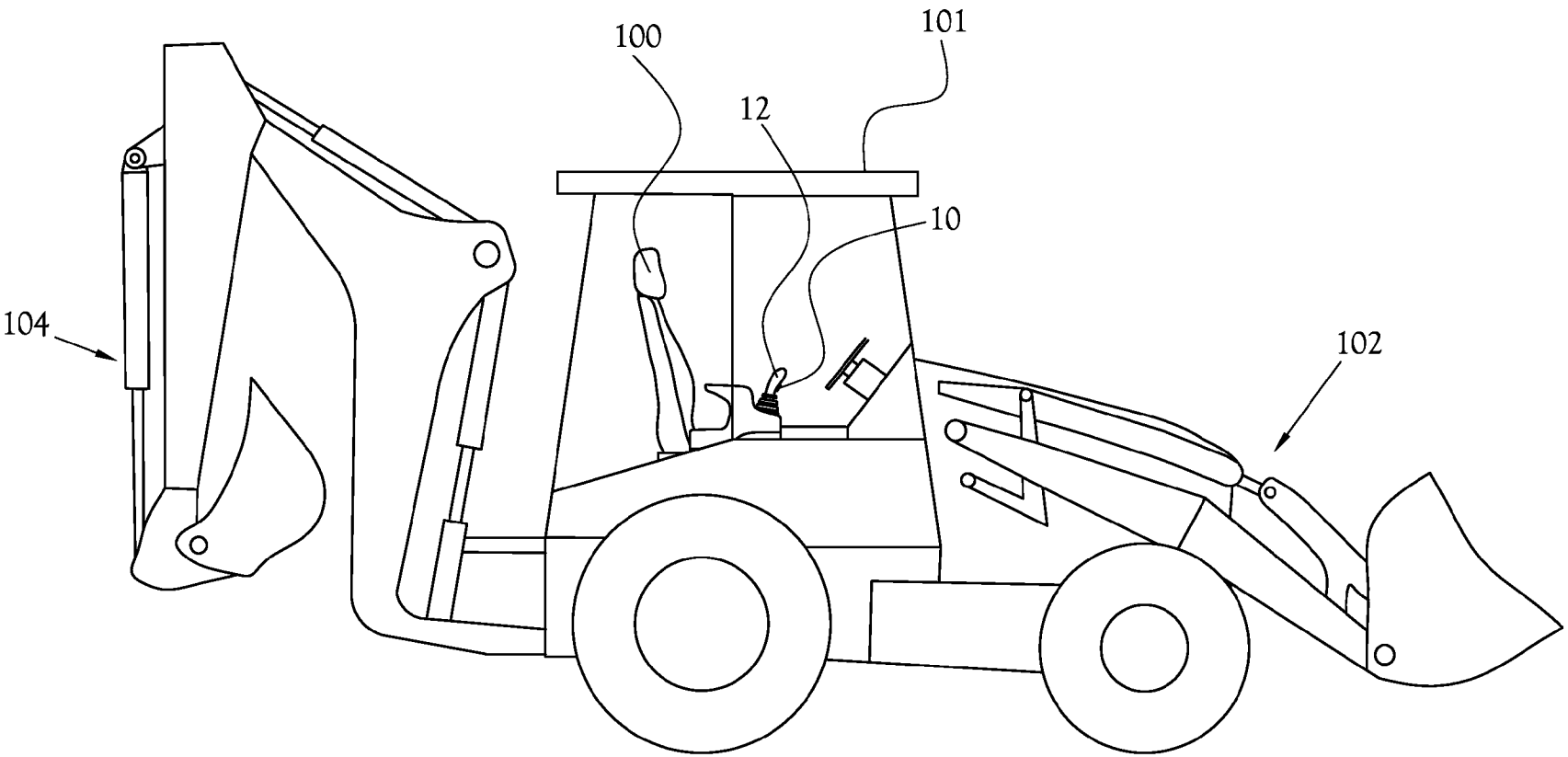
FIG. 1 illustrates a side view of a heavy equipment machine incorporating a joystick safety trigger and associated joystick according to an example embodiment of the present general inventive concept.

A power control system according to several features of the present general inventive concept is disclosed herein and illustrated in the accompanying figures. With reference to FIG. 1, in several embodiments, a joystick safety trigger 10, or "trigger," is integrated with an associated joystick 12, and is provided for use on a heavy equipment machine 101, such as for example the illustrated excavator or other vehicle, to allow use of the joystick 12 for operation of at least a portion of the heavy equipment machine 101, and to assist with preventing unintentional actuation of the joystick 12 of the type which may result in miss-operation of the heavy equipment machine 101. For example, in the illustrated embodiment, the trigger 10 and associated joystick 12 are disposed within the vicinity of an operator's seat 100 of the illustrated excavator 101 to allow operational control of various hydraulic apparatus forming the front-end loader portion 102 and the backhoe portion 104 of the excavator. It is understood that the joystick 12 is merely one example of a manual control that may be used to operate various mechanical devices provided to a heavy equipment machine, and that safety trigger 10 is merely one example of how a safety switch integrated with a manual control may be actuated by a user. For example, various example embodiments of the present general inventive concept may employ pressure sensors, capacitive elements, etc., to detect the engagement of a user's hands with the manual controls.

Figure 2:
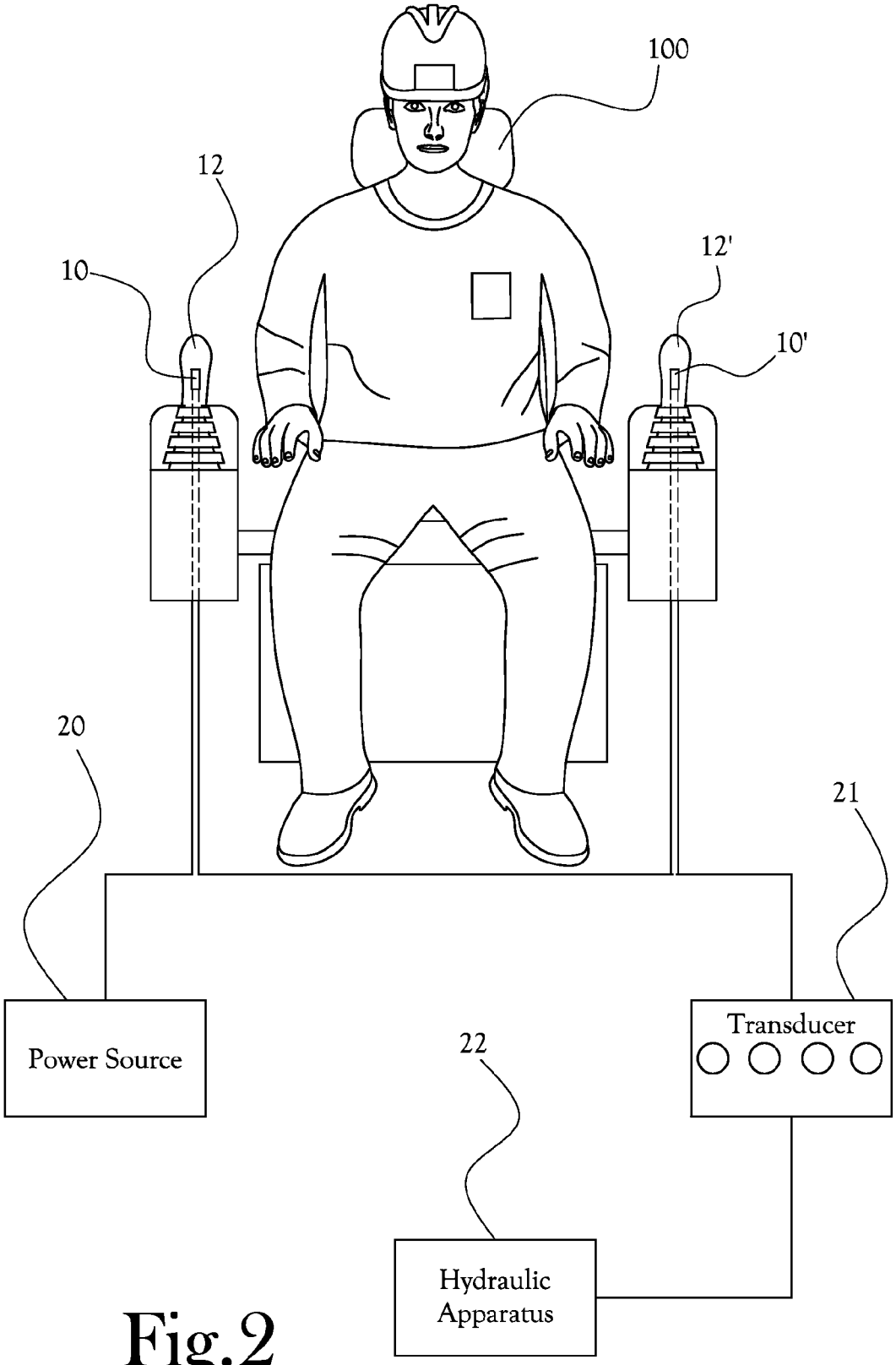
FIG. 2 illustrates a side view of a heavy equipment machine incorporating a joystick safety trigger and associated joystick according to an example embodiment of the present general inventive concept.

FIG. 2 is a partial schematic view illustrating an example embodiment of the present general inventive concept, in which two triggers 10, 10' and associated joysticks 12, 12' are provided at respective opposite right and left sides of an operator's seat 100 of an excavator 101 to allow for operational control of the hydraulic apparatus of the excavator 101 as discussed above. In the embodiment of FIG. 2, a power source 20 is provided, which supplies power to the hydraulic apparatus 22 of the excavator 101 through an electrically controlled hydraulic transducer 21, such as, in various example embodiments, a solenoid. In the illustrated embodiment, the power source 20 comprises an electrical power source, of the type configured to provide electrical current to a circuit. A first of the triggers 10 is provided in electrical communication with the power source 20 through suitable electrical connections and circuitry of the type known to one of ordinary skill in the art. The first trigger 10 is further in electrical communication with a second of the triggers 10', which is in turn provided in electrical communication with the transducer 21.

It will be understood that each of the triggers 10, 10' may operate effectively as a switch for the electrical connections between the triggers 10, 10', between the first trigger 10 and the power source 20, and between the second trigger 10' and the transducer 21. In the illustrated embodiment, each of the triggers 10, 10' is configured to a "closed" position when depressed against its respective joystick 12, 12', and is configured to an "open" position when released. Thus, in the illustrated embodiment, electrical connectivity between the power source 20 and the transducer 21 is accomplished upon depression of both the first and second triggers 10, 10'. However, release of either the first trigger 10 or the second trigger 10' interrupts electrical connectivity between the power source 20 and the transducer 21, thereby terminating the flow of electrical current from the power source 20 to the transducer 21. Thus, in order for the power source 20 to supply power to the transducer 21, and thereafter to the hydraulic apparatus 22, both triggers 10, 10' must be depressed.

In the illustrated embodiment, two joysticks 12, 12' are provided to allow control of the hydraulic apparatus 22, and two associated triggers 10, 10' are provided, one for each joystick 12, 12', to selectively allow communication between the power source 20 and the hydraulic apparatus 22 as discussed above. However, it will be understood that more or fewer triggers 10, 10' and associated joysticks 12, 12' may be provided, depending upon the needs of the heavy equipment 101 to be controlled, without departing from the spirit and scope of the present general inventive concept. For example, according to various example embodiments of the present general inventive concept, a single joystick 12 with associated trigger 10 may be provided. In other various example embodiments, the at least one joystick 12 and associated trigger 10 may be configured to control any of a plurality of hydraulic apparatus 22 through at least one, but possibly several, transducers 22. Those of skill in the art will recognize other suitable configurations through which the joystick safety trigger 10 of the present general inventive concept may be utilized without departing from the spirit and scope of the present general inventive concept.

Figure 3:
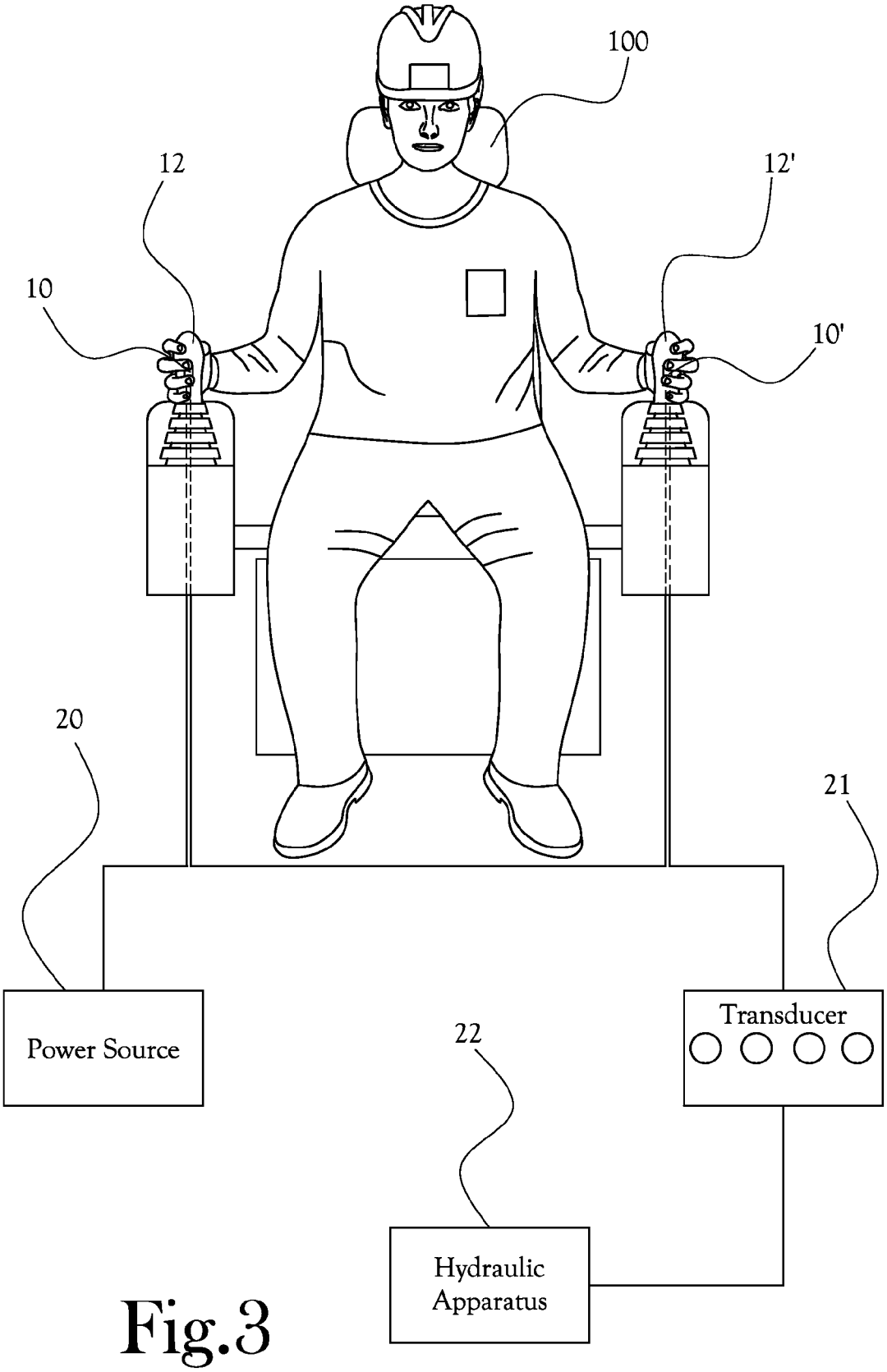
FIG. 3 is a partial schematic view illustrating the heavy equipment machine of FIG. 2, and illustrating operation of the two joystick safety triggers.

FIG. 3 illustrates an application of the embodiment of the present general inventive concept illustrated in FIG. 2. As illustrated in FIG. 3, during operation of the excavator 101, an operator is seated in the operator's seat 100 of the excavator 101 with the operator's hands placed on the joysticks 12, 12'. In this configuration, the operator is able to simultaneously depress both of the triggers 10, 10' while moving the joysticks 12, 12' in order to effect operational movement of the hydraulic apparatus 22. It will be understood that additional circuitry (not shown) may be provided to allow the joysticks 12, 12' to relay commands from the operator to the hydraulic apparatus 22, and such additional circuitry will become readily apparent to one of ordinary skill in the art. However, in the configuration illustrated in FIG. 3, it will be recognized that the operator may provide commands through actuation of the joysticks 12, 12' to effect operation of the hydraulic apparatus 22 only so long as both triggers 10, 10' are depressed. Upon releasing the triggers 10, 10', electrical communication between the power source 20, and the transducer 21 is terminated, and power ceases to flow to the hydraulic apparatus 22. As previously described, while triggers 10, 10' may be provided to the joysticks 12, 12' so that a proper engagement of the hands of the user to the joysticks 12, 12' may be determined, other safety switch/manual control configurations may be provided to detect such engagement of the user's hands to the controls.

Figure 4:
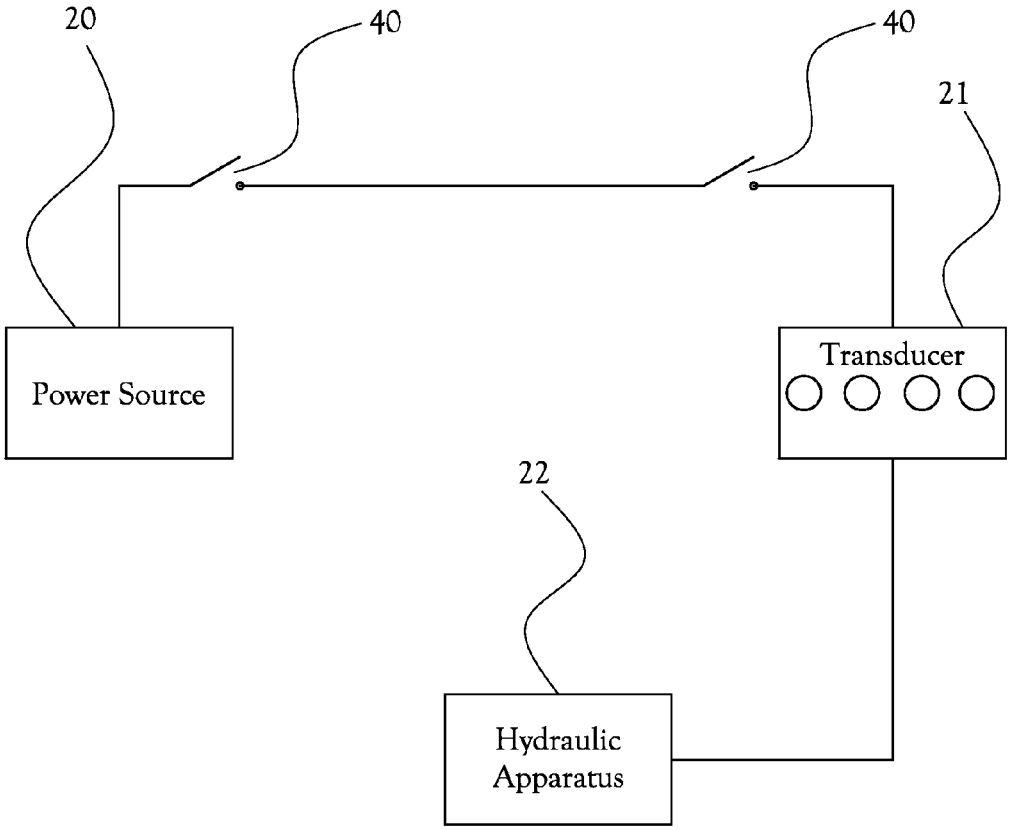
FIG. 4 is a schematic diagram illustrating an example embodiment of the present general inventive concept.

FIG. 4 is a schematic illustration of the electrical circuitry involved in the embodiment of FIG. 2 showing switches 40 at both points where the triggers 10, 10' are located in the circuitry. In the illustration of FIG. 4, both switches 40 are shown in the open position, indicating that each of the triggers 10, 10' is released. As described above, upon applying sufficient pressure on the triggers 10, 10' to engage them, the switches 40 become closed, and power can then flow to the hydraulic apparatus 22. Upon releasing the triggers 10, 10', the switches 40 open, and power can no longer flow to the hydraulic apparatus 22.

As can be understood from the description of some of the example embodiments discussed above, a method of controlling power supplied to a mechanical device provided in a heavy equipment machine, according to various example embodiments of the present general inventive concept, may include engaging first and second manual controls to maneuver the mechanical device. First and second safety switches respectively integrated with the first and second manual controls may be activated to cause power to be provided to the mechanical device, and deactivation of the first and/or second safety switches, such as by removing the hand of the user from either or both of the manual controls, releasing a trigger, etc., will prevent power from being provided to the mechanical device.

From the foregoing, it will be recognized that a joystick safety trigger 10 is provided which, when integrated into an accompanying joystick 12, provides a significant improvement over those joysticks known in the art. The joystick safety trigger 10 of the present general inventive concept provides a joystick which is less prone to response to unintentional movement of the joystick, thereby limiting potential miss-operation of machinery and equipment in communication with the joystick, and thereby providing improved safety features of the joystick incorporating the joystick safety trigger.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. A power control system to be used with heavy equipment, the power control system comprising:

a power source to provide a power signal to be used in a mechanical operation of the heavy equipment;

a mechanical device to perform the mechanical operation in response to receiving the power signal;

first and second manual controls to maneuver the mechanical device; and first and second safety switches respectively integrated with the first and second manual controls such that the power signal is only received by the mechanical device while both the first and second safety switches are simultaneously actuated by a user.

2. The power control system of claim 1, wherein the first and second safety switches are normally open, and actuation of the respective switches closes corresponding portions of a circuit between the power source and the mechanical device.

3. The power control system of claim 1, wherein the first and second safety switches are respectively actuated by detecting engagement of a user's hands at the respective first and second manual controls.

4. The power control system of claim 3, wherein the first and second manual controls are joysticks.

5. The power control system of claim 4, wherein the first and second safety switches are triggers respectively integrated with the joysticks.

6. The power control system of claim 4, wherein the first and second safety switches respectively include one or more pressure sensors to detect the engagement of the user's hands.

7. The power control system of claim 4, wherein the first and second safety switches respectively include one or more capacitive sensors to detect the hand of the user.

8. The power control system of claim 1, further comprising a transducer to provide power to the mechanical device in response to the first and second safety switches being actuated.

9. The power control system of claim 1, wherein the mechanical device includes at least two hydraulic apparatuses respectively controlled by the first and second manual controls.

10. A heavy equipment machine, comprising:

a power control system to control a mechanical operation of the heavy equipment machine, the power control system comprising:

a power source to provide a power signal to be used in a mechanical operation of the heavy equipment, a mechanical device to perform the mechanical operation in response to receiving the power signal, first and second manual controls to maneuver the mechanical device, and first and second safety switches respectively integrated with the first and second manual controls such that the power signal is only received by the mechanical device while both the first and second safety switches are simultaneously actuated by a user.

11. The heavy equipment machine of claim 10, wherein the heavy equipment machine is an earth-moving machine.

12. The heavy equipment machine of claim 10, wherein the mechanical device is driven by at least two hydraulic apparatuses which operate on different axes of movement.

13. The heavy equipment machine of claim 10, wherein the mechanical device is a loader, backhoe, excavator, or grader.

14. The heavy equipment machine of claim 10, wherein the first and second safety switches are normally open, and actuation of the respective switches closes corresponding portions of a circuit between the power source and the mechanical device.

15. The heavy equipment machine of claim 10, wherein the first and second manual controls are joysticks.

16. The power control system of claim 15, wherein the first and second safety switches are triggers respectively integrated with the joysticks.

17. A method of controlling power supplied to a mechanical device provided in a heavy equipment machine, the method comprising:

engaging first and second manual controls to maneuver the mechanical device;

activating first and second safety switches respectively integrated with the first and second manual controls to cause power to be provided to the mechanical device when the first and second switches are simultaneously activated; and deactivating either of the first and second safety switches to prevent power from being provided to the mechanical device.

18. The method of claim 17, wherein the first and second manual controls are joysticks; and the first and second safety switches are activated by applying pressure to first and second triggers respectively provided to the joysticks.

19. The method of claim 17, wherein the first and second safety switches are normally open, and activation of the respective switches closes corresponding portions of a circuit between a power source and the mechanical device.

20. The method of claim 17, wherein each of the first and second manual controls respectively controls at least one of a plurality of hydraulic apparatuses provided to the mechanical device.

* * * * *